US006895620B1

(12) United States Patent
Rensink

(10) Patent No.: US 6,895,620 B1
(45) Date of Patent: May 24, 2005

(54) HIGH COMFORT MATTRESSES AND METHODS FOR CONSTRUCTING THEM

(75) Inventor: Robert L Rensink, Denver, CO (US)

(73) Assignee: Denver Mattress Co., LLC, Lakewood, CO (US)

( * ) Notice: Subject to any disclaimer, the term of this patent is extended or adjusted under 35 U.S.C. 154(b) by 0 days.

(21) Appl. No.: 10/704,879

(22) Filed: Nov. 10, 2003

(51) Int. Cl.[7] ..... A47C 27/00
(52) U.S. Cl. ..... 5/721; 5/716; 5/690; 5/700
(58) Field of Search ..... 5/690, 700, 716, 5/721, 740

(56) References Cited

U.S. PATENT DOCUMENTS

| | | | | |
|---|---|---|---|---|
| 2,862,214 A | | 12/1958 | Thompson et al. | |
| 3,869,739 A | | 3/1975 | Klein | |
| 4,463,466 A | * | 8/1984 | May et al. | 5/721 |
| 5,040,255 A | | 8/1991 | Barber, Jr. | |
| 5,317,768 A | * | 6/1994 | Klancnik | 5/736 |
| 5,469,590 A | * | 11/1995 | Simon | 5/721 |
| 6,023,803 A | * | 2/2000 | Barman | 5/716 |
| 6,243,900 B1 | | 6/2001 | Gladney et al. | |
| 6,292,965 B1 | * | 9/2001 | Gambrell | 5/716 |
| 6,295,676 B1 | | 10/2001 | Warner | |
| 6,408,469 B2 | | 6/2002 | Gladney et al. | |
| 6,701,557 B2 | * | 3/2004 | Barman | 5/730 |
| 2002/0184712 A1 | | 12/2002 | Gladney et al. | |

FOREIGN PATENT DOCUMENTS

DE 8809029.9 2/1989

* cited by examiner

*Primary Examiner*—Michael Trettel
(74) *Attorney, Agent, or Firm*—Townsend and Townsend and Crew LLP

(57) ABSTRACT

In one embodiment, a mattress is constructed of a core having a first side and a second side. A first padding layer is positioned at the first side of the core and comprises a foam material having contoured surface facing away from the core. A second padding layer of a foam material is positioned adjacent the contoured surface of the first padding layer.

27 Claims, 4 Drawing Sheets

HIGH COMFORT MATTRESSES AND METHODS FOR CONSTRUCTING THEM

CROSS-REFERENCES TO RELATED APPLICATIONS

This application is related to copending U.S. application Ser. No. 10/705,640, filed on Nov. 10, 2003, still pending, the complete disclosure of this application is herein incorporated by reference.

BACKGROUND OF THE INVENTION

This invention relates generally to the field of mattresses, and in particular to high comfort mattresses. More specifically, the invention relates to arrangements of padding layers that may be used in combination with a mattress core to increase the comfort level of a mattress.

An uncomfortable mattress can be a significant factor in contributing to a poor night's sleep. Traditionally, mattresses have been constructed using a core of springs topped with a layer of padding. Some manufacturers have incorporated this padding into the quilting. Such mattresses are generally referred to as pillow top mattresses.

One way to improve the comfort level of a mattress is to utilize a piece of convoluted polyurethane foam as the padding layer. To reduce the "lumpiness" of this padding layer, some manufacturers have placed fibers in the valleys created by the convolutions. One example of this approach is described in U.S. Pat. No. 5,317,768, the complete disclosure of which is herein incorporated by reference. This design can be undesirable because the fibers can matt down in the valleys so that the convolutions lose their cushioning effect.

BRIEF SUMMARY OF THE INVENTION

The invention provides a variety of high comfort mattress systems and methods for making such mattresses. In one embodiment, a mattress comprises a core having a first side and a second side. The mattress also includes a first padding layer that is positioned at the first side of the core. The first padding layer has at least one contoured surface. A second padding layer is adjacent to the contoured surface. By using a padding layer against the contoured surface, the "lumpiness" of the mattress is eliminated while still permitting the contoured surface to reduce the pressure points on a sleeper's body. Also, this combination of materials better conforms to the shape of the sleeper's body. In this way, a luxurious feel is produced. Also, by using a contoured padding layer, material costs can be reduced because two pieces of a contoured material can be produced from a single layer of padding material. The first and second padding layers may be incorporated into the quilting or ticking (such by using a gusset) to form a pillow top mattress, or may be by incorporated directly into the mattress, known as a plush top arrangement.

In one aspect, the first and second padding layers may be constructed of a polyurethane foam. The contoured surface may also be convoluted, such as with an egg carton design having alternating peaks and valleys. The second padding layer may have a density in the range from about 0.5 pounds to about 1.9 pounds per cubic foot, and more preferably from about 0.5 pounds to about 0.9 pounds per cubic foot. In some cases, the density of the first padding layer may be larger than the second padding layer. The second padding layer may also have a mean indentation force deflection (IFD) in the range from about 5 to about 23, and more preferably from about 5 to about 15.

In one particular arrangement, the contoured surface may face away from the core so that the first layer is between the core and the second layer. Alternatively, the contoured surface may face toward the core so that the second layer is between the core and the first layer. In a further arrangement, an intermediary layer may be placed between the core and the first and second padding layers. Types of materials that may be used for the intermediary layer include polyurethane foams, latex rubber, visco-elastic or memory materials, densified fibers and the like.

The first and second layers may have a thickness in the range from about ⅜ inches to about 3 inches. The intermediary layer may have a thickness in the range from about 0.5 inches to about 3 inches.

A wide variety of mattress cores may be used. For example, the core may comprise springs, including open coil springs, pocketed springs, and the like. Other types of cores include those made from latex rubber, polyurethane foam, visco-elastic materials, air bladders, waterbeds and the like.

The mattress may also include a ticking layer on top of the padding layers. Also, an arrangement of padding layers that are on the first side of the core may also be included at the second side of the core. In some cases, the arrangement on the second side could be different from the first side.

In some cases, two second padding layers may be used in combination with the first padding layer having the contoured surface. The second padding layers may both be positioned on top of the first layer, or one may be above and one below. In another alternative, the mattress may include two first layers of foam that are convoluted in combination with the second layer. For example, the two first layers may have their contoured surfaces facing up, with the second layer resting on the contoured surface of the top first layer. As another example, one of the first layers may having its contoured surface facing up with the other first layer having its contoured surface facing down. The second layer rests on the contoured surface of the top first layer.

DETAILED DESCRIPTION OF THE INVENTION

Figure 1:
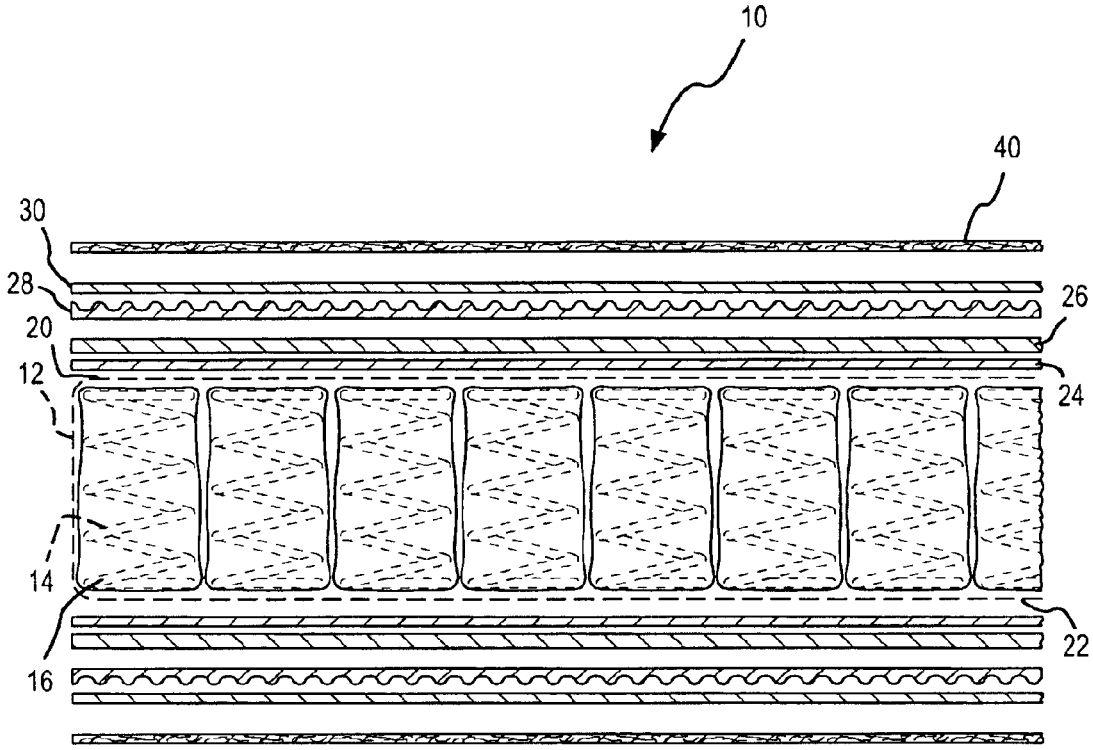
FIG. 1 is an exploded, schematic side view of an embodiment of a mattress according to the invention.
Figure 2:
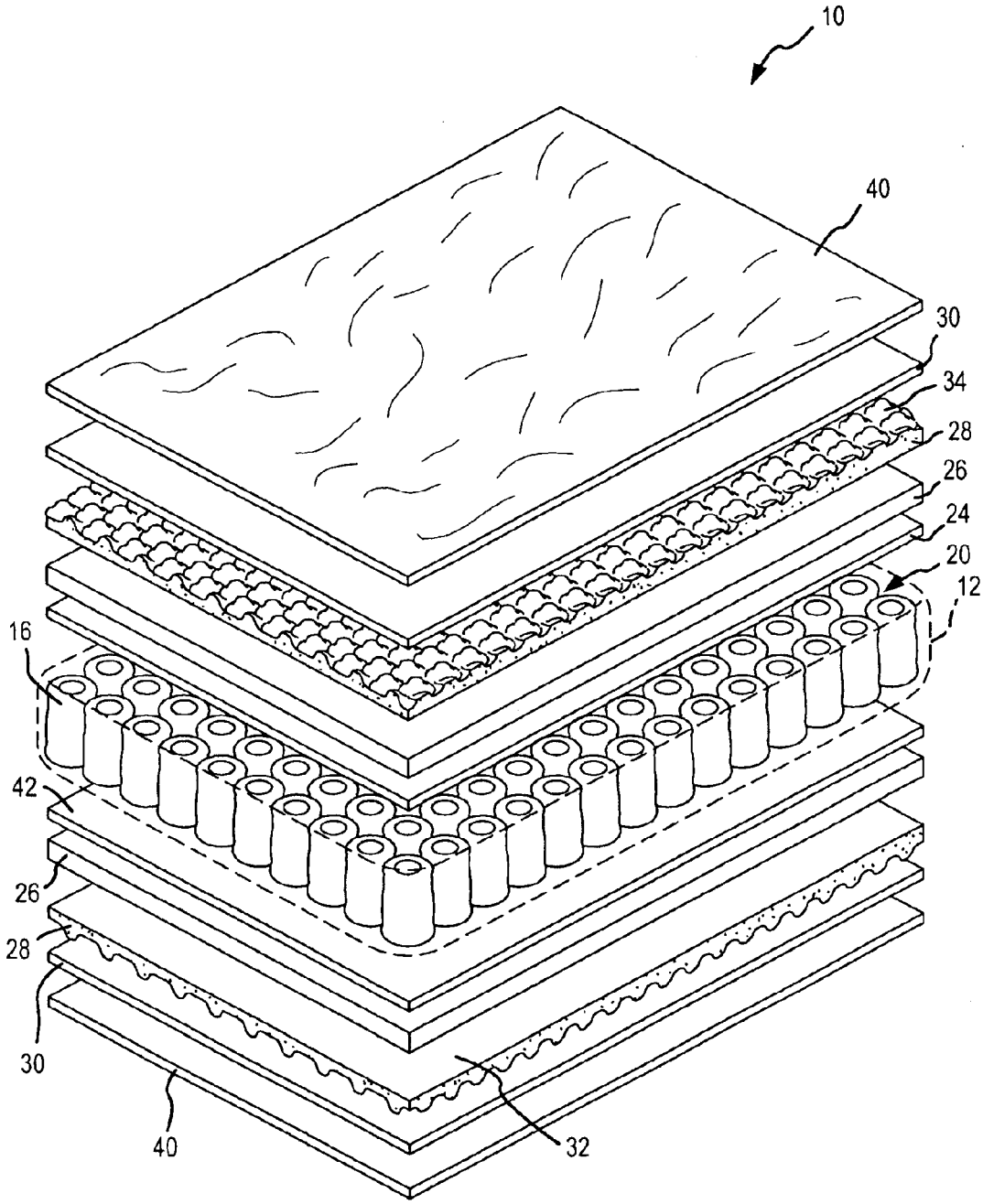
FIG. 2 is a perspective view of the mattress of FIG. 1.

The invention provides a variety of mattresses that provide a high level of comfort at reasonable manufacturing costs. The mattresses may utilize a variety of cores and a variety of padding layers arranged in a variety of ways. One example of a high comfort mattress is illustrated schematically in FIG. 1.

Mattress 10 utilizes a core 12 that provides the basic layer of support to the user's body. Mattress 10 may be used with essentially any type of core 12. For example, core 12 may comprise springs 14 that are encased in fabric pockets 16. Other cores include traditional open coil springs, latex rubber cores, visco-elastic cores, polyurethane cores, air bladders, waterbed cores, and the like. Hence, the invention is not intended to be limited to only a specific type of core. A border rod may be used to couple the core to an adjacent layer, although in some instances a foam casing or other border material may be placed around the core and the other layers.

For convenience of discussion, core 12 may have a first side 20 and a second side 22. A variety of optional padding layers and/or fabrics may be positioned adjacent to first side 20. For instance, a backing material may be placed next to core 12 for protection of core 12. One or more intermediate padding layers (such as layers 24 and 26) may be used to provide the mattress with additional comfort. These layers may be used alone or in various combinations. For example, layer 24 may comprise a foam material, such as a polyurethane foam. One particular type of polyurethane foam that may be used is one having a density in the range from about 0.5 pounds per cubic foot to about 1.9 pounds per cubic foot, and more preferably from about 0.5 pounds per cubic foot to about 0.9 pounds per cubic foot. The firmess of layer 24 may be in the range from about 5 IFD to about 23 IFD, and more preferably from about 5 IFD to about 15 IFD. Layer 24 may have a thickness in the range from about 0.5 inches to about 3 inches, and could have one or more convoluted surfaces. Polyurethane foams with such characteristics are manufactured under the trade name Quiltflex from FoamEx, Inc, although other manufacturers may be used as well.

Layer 26 may comprise a piece of latex rubber or a visco elastic material. One or both sides of layer 26 could also be convoluted. Layer 26 may have a thickness in the range from about 0.5 inches to about 5 inches. Other materials that may be used as an intermediate layer include densified fiber materials.

Mattress 10 also includes a combination of padding layers 28 and 30. As will be described in more detail hereinafter, one of layers 28 or 30 may have a contoured surface, and the other padding layer is placed adjacent to the contoured surface. The contoured surface may have a variety of configurations. For example, one type of contoured surface is a convoluted surface having alternating peaks and valleys similar to an egg carton. One example of this type of surface design is described in U.S. Pat. No. 5,317,768, incorporated herein by reference. Other types of contoured surfaces include ribs, zigzags, other surface modified foams that may have essentially any type of design, including patterns defining regions of higher and lower firmness, and the like.

Figure 3:
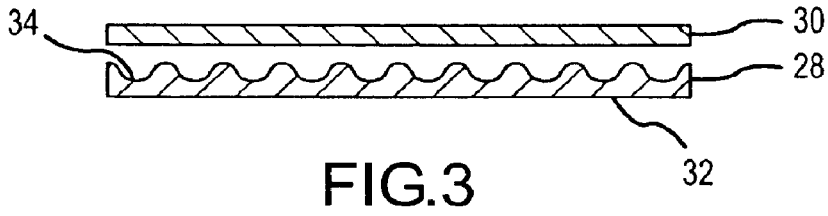
FIG. 3 is a side view of a convoluted foam layer adjacent another padding layer according to one embodiment of the invention.
Figure 4:
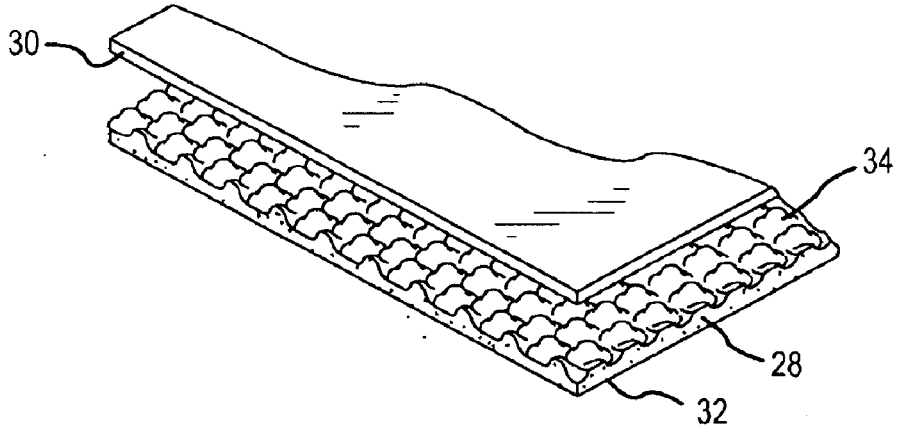
FIG. 4 is a perspective view of the arrangement of FIG. 3.

The padding layer having the contoured surface may be constructed from a polyurethane foam, although other materials could be used as well. As illustrated in FIGS. 3 and 4, layer 28 comprises a polyurethane foam having a flat surface 32 and a convoluted surface 34 that faces away from core 12. In this way, layer 28 is positioned between layer 30 and core 12. Layer 28 may have a density in the range from about 0.5 pounds per cubic foot to about 3 pounds per cubic foot, and sometimes from about 1.6 pounds per cubic foot to about 1.9 pounds per cubic foot. Layer 28 may have a firmness in the range from about 8 IFD to about 45 IFD. Layer 28 may have a thickness in the range from about ⅜ inches to about 3 inches, and sometimes about 1 inch to about 1.5 inches. Conveniently, the peaks may be about half the total thickness of layer 28.

Layer 30 provides a variety of important features when placed against the peaks of convoluted surface 34. Layer 30 when placed adjacent the peaks of layer 28 better conforms to the user's body as compared to just a convoluted surface. This provides additional comfort to the user. Further, because of the density and firmness of layer 30, it alone has a luxurious feel. When used in combination with convolutions, a high degree of comfort is provided to the user. As an additional feature, material costs can be reduced because two pieces of convoluted foam can be produced form a single piece of foam. For example, two layers 28 may have a height of about 1¼ inch and be produced from a piece of foam having a height of about 1.5 inches. This allows two contoured foam pieces to have a combined height of 2.5 inches. This can reduce the cost of layer 28 (as compared to using a piece of flat foam) by up to about 50%. When this layer is combined with layer 30, a plush and luxurious feel is produced at a reduced cost. For example, layer 30 may be about one inch while layer 28 is about 1¼ inch. This is about the same height as the original foam piece from which layer 28 was produced, but has a much more luxurious and body-conforming feel.

Figure 5:
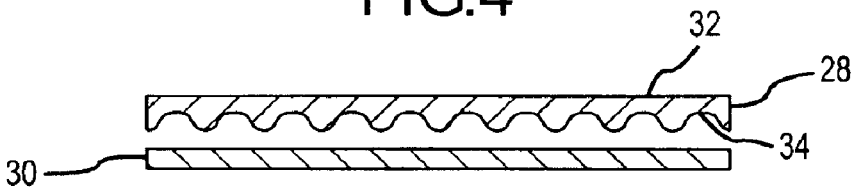
FIG. 5 is a side view of a convoluted foam layer adjacent another padding layer according to another embodiment of the invention.
Figure 6:
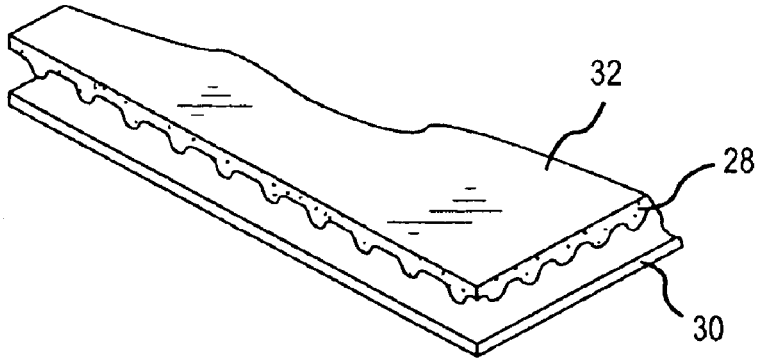
FIG. 6 is a perspective view of the arrangement of FIG. 5.

As shown in FIGS. 4 and 5, layers 28 and 30 may be flipped so that convoluted surface 34 faces toward core 12. Also, layer 30 is positioned between layer 28 and core 12.

Mattress 10 also includes a layer of ticking 40 that is a piece of fabric or quilting that envelopes the mattress as is known in the art. Ticking 40 may comprise essentially any type of fabric or covering and may be sewn to form it around the core and other padding layers. Layers 28 and 30 may be incorporated into ticking 40 using a gusset that runs beneath layer 30 to form a pillow top. Alternatively, ticking 40 may be placed over layer 28 and along the sides of the mattress to form a plush top mattress.

As mentioned herein, intermediate layers may be positioned between core 12 and layers 28 and 30. In some cases, additional layers could also be placed on type of layers 28 and 30. As another variation, a mattress may include multiple combinations of layers 28 and 30 on the same side of the core. These could be adjacent to each other or separated by other layers. Mattress 10 may be configured as a traditional two sided mattress or a one-sided or so-called no-flip mattress. For a one-sided mattress configuration, side 22 of core 12 may include a bottom support layer 42. A variety of materials may be used to construct layer 42 including a matrix of foam elements, polyurethane foam, and the like. Examples of how to construct layer 42 and to couple it to core 12 are described in copending U.S. application Ser. No. 10/705,640, ("No-Flip Mattress Systems and Methods"), filed on the same date as the present application and incorporated herein by reference.

For a two sided mattress, the same layers that are included on side 20 may be replicated on side 22. In some cases, a different arrangement could be provided on side 22 to provide a mattress having different comfort levels for each side.

In some cases, two padding layers 30 may be used in combination with padding layer 28 having the contoured surface. The padding layers 30 may both be positioned on top of layer 28, or one may be above and one below. In another alternative, the mattress may include two layers 28 of foam that are contoured in combination with layer 30. For example, the two layers 28 may have their contoured surfaces facing up, with layer 30 resting on the contoured surface of the top layer 28. As another example, one of the layers 28 may having its contoured surface facing up with the other layer 28 having its contoured surface facing down. Layer 30 rests on the contoured surface of the top layer 28.

Figure 7:
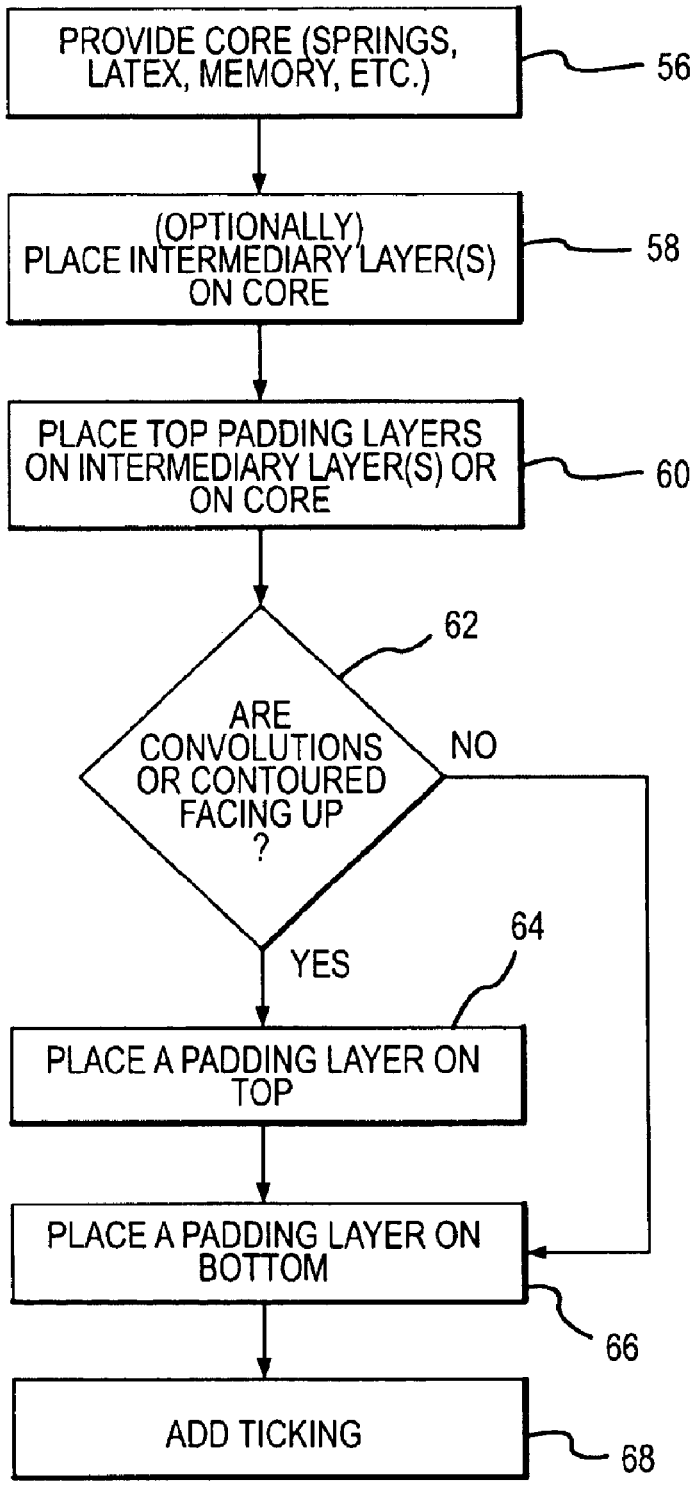
FIG. 7 is a flow chart illustrating one method for making a mattress according to the invention.

Referring now to FIG. 7, one method for constructing a mattress will be described. A shown in step 56, the process utilizes a core. This may be any of the cores described herein. Optionally, one or more intermediary layers may be placed adjacent the core as shown in step 58. A set of top padding layers are placed on the intermediary layers or adjacent the core as shown in step 60. One of the top padding layers may have convolutions or contours that face away from or toward the core as shown in step 62. If facing up or away from the core, a padding layer is placed on top of the contoured surface as shown in step 64. If facing down, the additional padding layer may be placed between the contoured surface and the core as shown in step 66. When all layers have been added, a layer of ticking is placed around the mattress to complete its construction as shown in step 68. In cases where the top padding layers are incorporated into the ticking to form a pillow top mattress, these steps may be done before placing the ticking around the mattress.

The invention has now been described in detail for purposes of clarity and understanding. However, it will be appreciated that certain changes and modifications may be practiced within the scope of the appended claims.

What is claimed is:

1. A mattress comprising:

a core having a first side and a second side;

a first padding layer positioned at the first side of the core, the first padding layer having at least one contoured surface;

a second padding layer adjacent the contoured surface of the first padding layer, wherein the second padding layer comprises a polyurethane foam having a density in the range of about 0.5 pounds to about 1.9 pounds and an IFD in the range from about 5 to about 23; and wherein the first padding layer has a density in the range from about 0.5 Pounds to about 3 pounds and an IFD in the range from about 8 to about 45.

2. A mattress as in claim 1, wherein the second padding layer has a density in the range from about 0.5 pounds to about 0.9 pounds and an IFD in the range from about 5 to about 15.

3. A mattress as in claim 1, wherein the first padding layer comprises a polyurethane foam, wherein the contoured surface is convoluted, and wherein the first padding layer also includes a planar surface.

4. A mattress as in claim 1, wherein the first padding layer has a density that is greater than that of the second layer.

5. A mattress as in claim 1, wherein the contoured surface faces away from the core, and wherein the first padding layer is positioned between the core and the second padding layer.

6. A mattress as in claim 1, wherein the contoured surface faces toward the core, and wherein the second padding layer is positioned between the core and the first padding layer.

7. A mattress as in claim 1, further comprising at least one intermediary padding layer between the core and the first and second padding layers.

8. A mattress as in claim 7, wherein the intermediary layer is selected from a group of materials consisting of polyurethane foam, latex and visco-elastic materials.

9. A mattress as in claim 1, wherein the first padding layer has a thickness in the range from about ⅜ inch to about 3 inches, and wherein the second padding layer has a thickness in the range from about ⅜ inches to about 3 inches.

10. A mattress as in claim 1, wherein the core is selected from a group consisting of spring cores, latex cores, visco-elastic cores and bladders.

11. A mattress as in claim 1, further comprising a ticking layer.

12. A mattress as in claim 1, further comprising a third padding layer positioned at the second side of the core, the third padding layer having at least one contoured surface, and a fourth padding layer adjacent the contoured surface of the third padding layer.

13. A mattress comprising:

a core having a first side and a second side;

a first padding layer positioned at the first side of the core, wherein the first padding layer comprises a resilient material having a contoured surface facing away from the core, wherein the first padding layer has an IFD in the range from about 8 to about 45; and a second padding layer comprising a resilient material positioned adjacent the contoured surface of the first padding layer, wherein the second padding layer has an IFD in the range from about 5 to about 23.

14. A mattress as in claim 13, wherein both the first padding layer and the second padding layer comprise a polyurethane foam.

15. A mattress as in claim 13, wherein the second padding layer has a density in the range from about 0.5 pounds to about 1.9 pounds.

16. A mattress as in claim 15, wherein the second padding layer has a density in the range from about 0.5 pounds to about 0.9 pounds and an IFD in the range from about 5 to about 15.

17. A mattress as in claim 13, wherein the first padding layer comprises a polyurethane foam, wherein the contoured surface is convoluted, and wherein the first padding layer also includes a planar surface.

18. A mattress as in claim 13, wherein the first padding layer has a density that is greater than that of the second layer.

19. A mattress as in claim 13, further comprising at least one intermediary padding layer between the core and the first and second padding layers.

20. A method as in claim 19, wherein the intermediary layer is selected from a group of materials consisting of polyurethane foam, latex materials and visco-elastic materials.

21. A mattress as in claim 13, wherein the first padding layer has a thickness in the range from about ⅜ inches to about 3 inches, and wherein the second padding layer has a thickness in the range from about ⅜ inches to about 3 inches.

22. A mattress as in claim 13, wherein the core is selected from a group consisting of spring cores, latex cores, visco-elastic cores and bladders.

23. A mattress as in claim 13, further comprising a ticking layer.

24. A mattress as in claim 13, further comprising a third padding layer positioned at the second side of the core, the third padding layer having at least one contoured surface, and a fourth padding layer adjacent the contoured surface of the third padding layer.

25. A method for constructing a mattress, the method comprising:

providing a mattress core having a first side and a second side;

providing a first padding layer comprising a resilient material having a contoured surface, wherein the first padding layer has an IFD in the range from about 8 to about 45;

providing a second padding layer comprising a resilient material, wherein the second padding layer has an IFD in the range from about 5 to about 23;

placing the second padding layer adjacent to the contoured surface of the first padding layer, with the contoured surface facing away from the first side of the mattress core; and covering the mattress core, the first padding layer and the second padding layer with a ticking.

26. A method as in claim 25, further comprising placing an intermediary padding layer between the first padding layer and the mattress core.

27. A method as in claim 25, further comprising placing a third padding layer and a fourth padding layer at the second side of the mattress core, with the third padding layer having a contoured surface that is adjacent to the fourth padding layer.

* * * * *